US007646351B2

(12) United States Patent
Wang

(10) Patent No.: US 7,646,351 B2
(45) Date of Patent: Jan. 12, 2010

(54) DETACHABLE VEHICLE ROOF ANTENNA

(75) Inventor: Jinsong Wang, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 11/554,202

(22) Filed: Oct. 30, 2006

(65) Prior Publication Data

US 2007/0097002 A1 May 3, 2007

(30) Foreign Application Priority Data

Oct. 31, 2005 (JP) ..... 2005-316282

(51) Int. Cl.
*H01Q 1/32* (2006.01)
*H01Q 1/12* (2006.01)

(52) U.S. Cl. ..... 343/715; 343/713; 343/888

(58) Field of Classification Search ..... 343/711, 343/712, 713, 715, 906, 888, 889, 900, 878
See application file for complete search history.

(56) References Cited

U.S. PATENT DOCUMENTS 4,021,809 A * 5/1977 Klancnik ..... 343/715
5,714,963 A * 2/1998 Cox ..... 343/786
6,275,194 B1 * 8/2001 Ansorge ..... 343/713
6,331,838 B1 * 12/2001 Scott et al. ..... 343/715
6,469,678 B1 * 10/2002 Pullen ..... 343/888
6,747,603 B1 * 6/2004 Tornatta et al. ..... 343/715
2006/0110977 A1 * 5/2006 Matthews ..... 439/578

FOREIGN PATENT DOCUMENTS

JP 2005-39412 2/2005

* cited by examiner

*Primary Examiner*—Hoang V Nguyen
*Assistant Examiner*—Robert Karacsony
(74) *Attorney, Agent, or Firm*—McGlew and Tuttle, P.C.

(57) ABSTRACT

A base side connecting mechanism (30) comprises a holder (40), a plug metal (50) and a sleeve (70). The plug metal (50) has a shaft (51) and a lock pin (52) projecting from the shaft (51) in a radial direction. The sleeve (70) is disposed to move slidingly along an axial direction of the shaft (51), is supported by the plug metal (50) through a wave washer (60), and receives biasing power toward an antenna mast (100) side. A mast side connecting mechanism (120) comprises a circular cylinder portion (121). The circular cylinder portion (121) is formed to press the sleeve (70) along the axial direction and has loosely penetrated portions (124, 125) in which the lock pin (52) can move along a circumferential direction and in which other end portions are large-diameter.

11 Claims, 4 Drawing Sheets

DETACHABLE VEHICLE ROOF ANTENNA

RELATED APPLICATION

This application relates to and claims priority from corresponding Japanese Patent Application No. 2005-316282 filed on Oct. 31, 2005.

BACKGROUND OF THE INVENTION

1. Field of the Invention

The present invention relates to a detachable vehicle antenna in which an antenna mast installed on a vehicle such as an automobile can be attached and detached, and more particularly to a detachable vehicle antenna which is enhanced waterproof performance and dustproof performance.

2. Description of the Related Art

As an antenna installed on a roof of a vehicle such as an automobile, it is known that an antenna mast is installed attachably and detachably to an antenna base fixed on the roof. Such detachable vehicle antenna is disclosed in, for example, Japanese Patent Application Kokai Publication No. 2005-39412. The detachable vehicle antenna aims to protect damage to the antenna mast caused by using an automatic car wash or tower parking, and has a structure in which the antenna mast can be detached from the antenna base by a user without any tools. Specifically, a male portion of a connector provided at the antenna mast side is fit into a female portion of a connector provided at the antenna base side, and the connectors are mechanically and electrically connected with each other by rotating the mast 90 degrees.

The above-described detachable vehicle antenna has the following problems. That is, dust is liable to accumulate at the connecting portion of the antenna base side, and waterproof function is not enough. Also, the antenna mast is liable to slacken, and since the antenna mast can be installed in a back to front direction, there is a potential risk of damage while driving.

SUMMARY OF THE INVENTION

An object of the present invention, therefore, is to overcome the problems existing in the prior art, and to provide a detachable vehicle antenna in which dust is hard to accumulate at a connecting portion between an antenna mast and an antenna base, and which has an enough waterproof structure, and further in which the antenna mast can reliably be installed and deinstalled even if the antenna mast is attachable and detachable.

According to one aspect of the invention, there is provided a detachable vehicle antenna comprising:

an antenna base provided on a vehicle;

an antenna mast installed attachably and detachably to the antenna base;

a first connector assembly disposed on the antenna base toward the antenna mast;

a second connector assembly disposed on the antenna mast toward the antenna base, and formed to be fittable into the first connector assembly along a predetermined axial direction; and a lock mechanism connecting mechanically and electrically between the first connector assembly and the second connector assembly, the lock mechanism having a movable portion which is movable along the predetermined axial direction by pressing of the second connector assembly toward the first connector assembly side, and lock portions which are locked with each other by rotating the first connector assembly and the second connector assembly about the predetermined axis.

The lock mechanism may comprise:

a plug of conductive material provided on one of the first connector assembly and the second connector assembly, and protruding toward the other of the first connector assembly and the second connector assembly;

a seal portion provided on one of the first connector assembly and the second connector assembly, and constructing the movable portion; and a plug receiving portion provided on the other of the first connector assembly and the second connector assembly, pressing the seal portion during fitting, and connected to the plug.

The seal portion may be formed cylindrically to surround a periphery of the plug, and the plug receiving portion is formed cylindrically in the same axis of the plug.

The seal portion may comprise conductive material.

The first connector assembly may comprise a projecting portion formed on a surface connected with the second connector assembly, and the second connector assembly may comprise a depressed portion formed on a surface connected with the first connector assembly and fitting into the projecting portion.

The plug may comprise a lock pin projecting from both sides of the plug in a radial direction, and projecting amounts of both ends of the lock pin may be different from each other.

According to the present invention, even if an antenna has an attachable and detachable antenna mast, dust is hard to accumulate at the connecting portion between the antenna mast and the antenna base, and the antenna has an enough waterproof structure, and further the antenna mast can be reliably attached and detached.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 1:
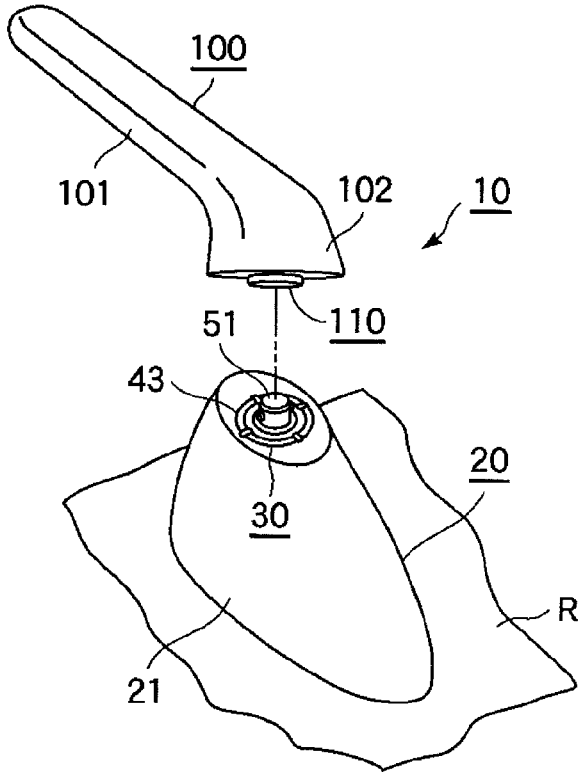
FIG. 1 is a perspective view showing a whole appearance structure of an embodiment of a detachable vehicle antenna according to the present invention.
Figure 2:
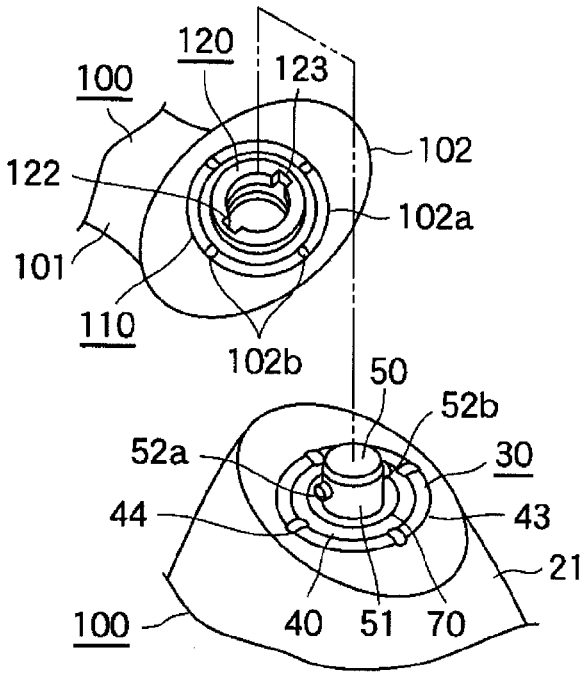
FIG. 2 is a perspective view showing an appearance of a base side connecting mechanism and a mast side connecting mechanism integrated into the detachable vehicle antenna of the embodiment according to the present invention.
Figure 3:
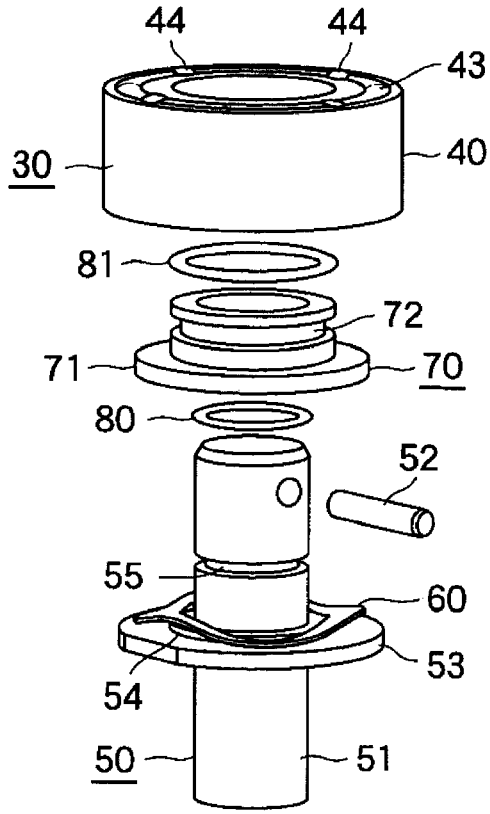
FIG. 3 is an exploded perspective view showing the base side connecting mechanism integrated into the detachable vehicle antenna of the embodiment according to the present invention.
Figure 4:
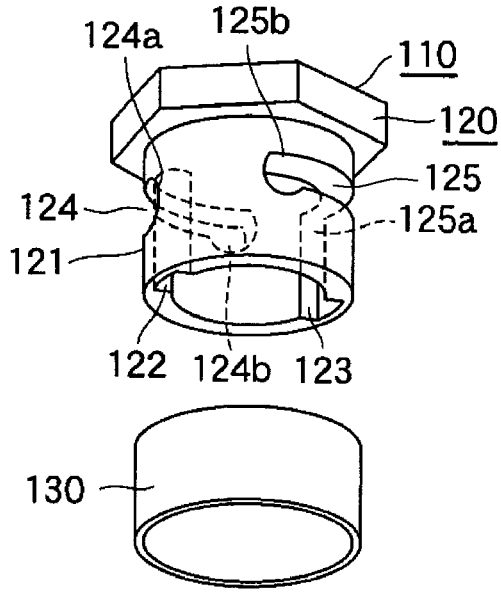
FIG. 4 is an exploded perspective view showing the mast side connecting mechanism integrated into the detachable vehicle antenna of the embodiment according to the present invention.
Figure 5:
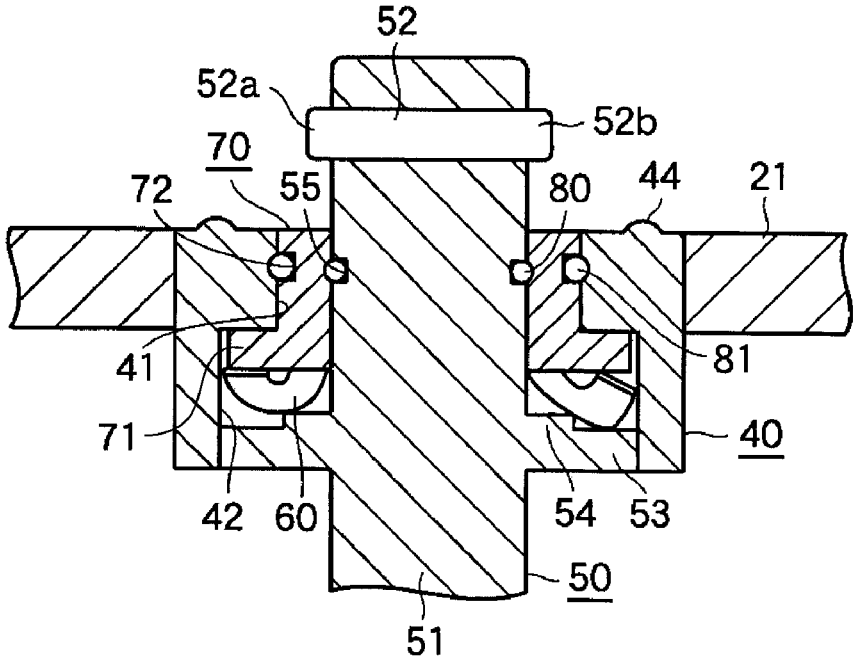
FIG. 5 is a longitudinal sectional view showing a state before connecting the mast side connecting mechanism to the base side connecting mechanism integrated into the detachable vehicle antenna of the embodiment according to the present invention.
Figure 6:
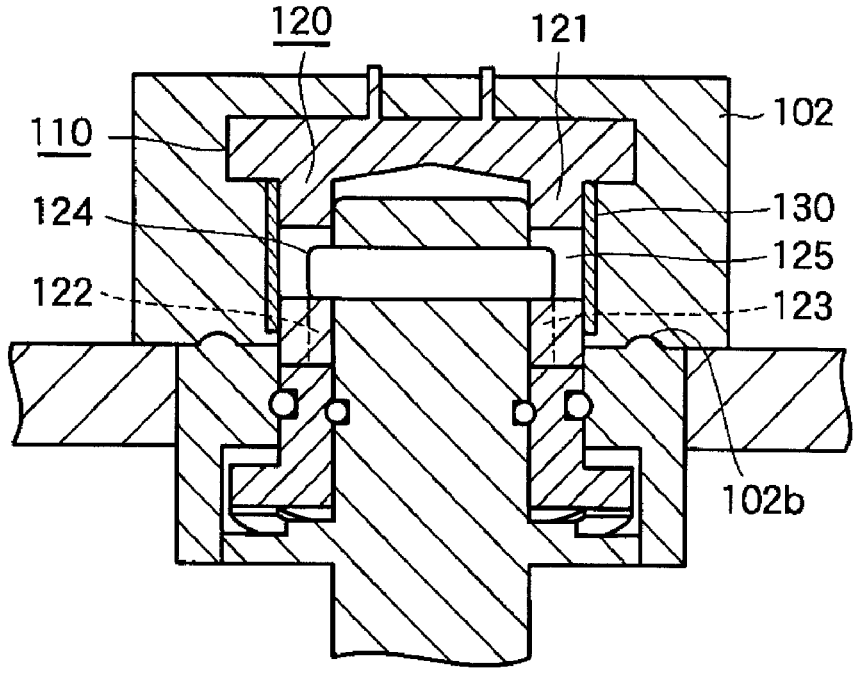
FIG. 6 is a longitudinal sectional view showing a state after connecting the mast side connecting mechanism to the base side connecting mechanism integrated into the detachable vehicle antenna of the embodiment according to the present invention.

Now, a first embodiment according to the invention is explained with reference to the drawings. FIG. 1 is a perspective view showing a whole appearance structure of an embodiment of a detachable vehicle antenna 10 according to the present invention. FIG. 2 is a perspective view showing an appearance of a base side connecting mechanism 30 and a mast side connecting mechanism 110 integrated into the detachable vehicle antenna 10. FIG. 3 is an exploded perspective view showing the base side connecting mechanism 30. FIG. 4 is an exploded perspective view showing the mast side connecting mechanism 110. FIG. 5 is a longitudinal sectional view showing a state before connecting the mast side connecting mechanism to the base side connecting mechanism 30. FIG. 6 is a longitudinal sectional view showing a state after connecting the mast side connecting mechanism 110 to the base side connecting mechanism 30.

As shown in FIG. 1, the detachable vehicle antenna 10 has an antenna base 20 attached to a vehicle roof R, and an antenna mast 100 attached to the antenna base 20 attachably and detachably.

The antenna base 20 has a base body 21 which has an almost circular truncated cone shape leaning to a backside of the vehicle, and a base side connecting mechanism (a first connector assembly) 30 which is provided on the base body 21. The base side connecting mechanism 30 is electrically and mechanically connected with a mast side connecting mechanism 110 explained later.

As shown in FIG. 2, the base side connecting mechanism 30 has a cylindrical holder 40 and a plug metal 50 of conductive material. An upper surface of the holder 40 is formed on the same surface as or a higher position than the base body 21, and the holder 40 constitutes a part of the base body 21. The plug metal 50 is disposed cylindrically in the same axis of the holder 40 and further protrudes from the upper surface of the holder 40 toward the antenna mast 100. The base side connecting mechanism 30 also has a cylindrical sleeve (a seal portion) 70 of conductive material which is provided along a peripheral surface of the plug metal 50 and which is movable along an axial direction in the plug metal 50. As shown in FIGS. 3 and 5, the sleeve 70 is supported by a wave washer (a biasing member) 60 within the holder 40, and receives biasing power applied toward the antenna mast 100 by the wave washer 60.

As shown in FIG. 5, the holder 40 has a first inner diameter portion 41 and a second inner diameter portion 42, those inner diameters being different from each other, and the inner diameter of the second inner diameter portion 42 is larger than that of the first inner diameter portion 41.

As shown in FIGS. 2 and 3, a projecting rim portion 43 formed circularly, and convex portions 44 formed on every 90 degrees along a circumferential direction of the projecting rim portion 43 are formed on the upper surface of the holder 40. Although the projecting rim portion 43 and the convex portions 44 are formed in one body, those may be formed separately.

The plug metal 50 has a cylindrical shaft 51, a lock pin 52 that is pressed into a tip side of the shaft 51 and that both end portions 52*a* and 52*b* project to a radial direction of the shaft 51, a flange portion 53 formed on a lower side of the shaft 51. A lower end of the shaft 51 is connected to, for example, a tuner unit (not shown) through a coaxial cable (not shown). Projecting amounts of the both end portions 52*a* and 52*b* of the lock pin 52 are the same, and if necessary, those may be different from each other so as not to be attached reversely. The projecting amounts of the both end portions 52*a* and 52*b* are set corresponding to depths of groove portions 122 and 123 described later. As shown in FIG. 5, a bump portion (control member) 54 is formed on the flange portion 53 and is abutted on a bottom surface of the sleeve 70. Also, an outer peripheral groove 55 is formed on an outer peripheral surface of the shaft 51 which moves slidingly in association with an inner peripheral surface of the sleeve 70, and an O-ring 80 is mounted thereon. The O-ring 80 allows the shaft 51 and the sleeve 70 to move slidingly in an airtight and liquidtight state.

The wave washer 60 is placed between the flange portion 53 and a bottom surface of a flange portion 71 of the sleeve 70 described later. A coil spring, a plate spring, a resin material etc. other than the wave washer may be used as the biasing member. Necessary power for attaching and detaching the mast or fixed power can be adjusted by selecting the biasing member appropriately.

Though the wave washer 60 is compressed by moving of the sleeve 70 downwardly as described later, the compression is limited to a certain level because the sleeve 70 is abutted on the bump portion 54 before the wave washer is completely compressed. Therefore, by adjusting a protruding amount of the bump portion 54, the wave washer 60 can be compressed and expanded only within an elasticity deformation limit, so that a lifetime of the wave washer 60 can be improved. This point is also the same as in the case where another biasing member is used.

Again referring to FIG. 5, the sleeve 70 is formed cylindrically, and the flange portion 71 is formed on a bottom portion of an outer peripheral surface thereof. The outer peripheral surface of the sleeve 70 is formed to be movable slidingly in association with an inner peripheral surface of the first inner diameter portion 41 of the holder 40. An outer diameter of the flange portion 71 is formed to be smaller than the inner diameter of the second inner diameter portion 42 of the holder 40.

An outer peripheral groove 72 is formed on the outer peripheral surface of the sleeve 70 which moves slidingly in association with the inner peripheral surface of the first inner diameter portion 41 of the holder 40, and an O-ring 81 is mounted thereon. The O-ring 81 allows the sleeve 70 and the holder 40 to be movable slidingly in an airtight and liquidtight state.

On the other hand, as shown in FIG. 1, the antenna mast 100 has a mast body 101 of conductive material, and a cover portion 102 provided on a bottom portion of the mast body 101, and a mast side connecting mechanism (a second connector assembly) 110 provided on the cover portion 102 toward the antenna base 20.

As shown in FIGS. 2 and 4, the mast side connecting mechanism 110 has a socket metal 120 of conductive material which is in a cylindrical form having a bottom and which presses the sleeve 70 toward the base body 21, and a spacer 130 which covers an outer peripheral surface of a circular cylinder portion 121 as described later of the socket metal 120.

A circular groove 102*a* and concave portions 102*b* formed on every 90 degrees along a circumferential direction of the circular groove 102*a* are formed on the cover portion 102. The circular groove 102*a* and the concave portions 102*b* are formed to fit into the projecting rim portion 43 and the convex portions 44, respectively.

As shown in FIG. 4, a circular cylinder portion (a plug receiving portion) 121 of the socket metal 120 has an inner peripheral surface, that opening portion is directed toward the antenna base 20, and that fits into the outer peripheral surface of the shaft 51 of the plug metal 50 to move rotationally around an axis. Groove portions 122 and 123 are provided in parallel to the axis on the circular cylinder portion 121 so that the both end portions 52*a* and 52*b* of the lock pin 52 of the shaft 51 can be inserted therein respectively only at a predetermined rotation angle around the axis. Further, loosely penetrated portions 124 and 125 are provided along a circumferential direction of the circular cylinder portion 121, in which the both end portions 52*a* and 52*b* of the lock pin 52 are movable respectively. One end portions 124*a* and 125*a* of the loosely penetrated portions 124 and 125 are communicatively connected to the groove portions 122 and 123, respectively. The other end portions 124*b* and 125*b* of the loosely penetrated portions 124 and 125 extend toward an opposite direction of the biasing power of the wave washer 60, that is, extend downwardly in FIG. 4.

In the detachable vehicle antenna 10 as structured above, the detaching can be conducted by the following so-called twist lock. In the case where the antenna mast 100 is attached to the antenna base 20, the mast side connecting mechanism 110 of the antenna mast 100 is faced toward the base side connecting mechanism 30 of the antenna base 20. The shaft 51 of the plug metal 50 is covered by the circular cylinder portion 121 of the mast side connecting mechanism 110. At this time, when the both end portions 52*a* and 52*b* correspond to the groove portions 122 and 123, the plug metal 50 is inserted into the circular cylinder portion 121. In the case where the lock pin 52 is structured such that the projecting amounts of the both end portions 52*a* and 52*b* are different from each other at the both sides, only when the both end portions 52*a* and 52*b* are in a certain direction, that is, correspond to the groove portions 122 and 123 respectively, the plug metal 50 can be inserted.

The lower end of the circular cylinder portion 121 is abutted on the upper end of the sleeve 70. Where the circular cylinder portion 121 is continued to be inserted in opposition to the biasing power of the wave washer 60, the both side portions 52*a* and 52*b* of the lock pin 52 reach the loosely penetrated portions 124 and 125. And then when the antenna mast 100 is rotated, for example, 90 degrees clockwise, the both end portions 52*a* and 52*b* of the lock pin 52 move along the loosely penetrated portions 124 and 125. At the time when the both end portions 52*a* and 52*b* of the lock pin 52 reach the other end portions 124*b* and 125*b* of the loosely penetrated portions 124 and 125, the lock pin 52 is fixed therein (referring to FIG. 6).

The other end portions 124*b* and 125*b* of the loosely penetrated portions 124 and 125 are pressed with the upward biasing power from the wave washer 60 against the both end portions 52*a* and 52*b* of the lock pin 52. In addition, since the circular cylinder portion 121 is further pressed to the sleeve 70 against the biasing power from the wave washer 60 so as to unlock the both end portions 52*a* and 52*b* of the lock pin 52 from the other end portions 124*b* and 125*b*, the antenna mast 100 would not slacken or fall off by vibration on driving.

In the case where the antenna mast 100 is detached from the antenna base 20, the antenna mast 100 is pressed temporarily and is rotated in an opposite direction for fixing the mast, i.e., for example, 90 degrees counterclockwise, so that the both end portions 52*a* and 52*b* of the lock pin 52 are released from the other end portions 124*b* and 125*b* of the loosely penetrated portions 124 and 125. By doing so, the both end portions 52*a* and 52*b* of the lock pin 52 move toward the one end portions 124*a* and 125*a* through the loosely penetrated portions 124 and 125. Once the both end portions 52*a* and 52*b* of the lock pin 52 reach the one end portions 124*a* and 125*a* side, the circular cylinder portion 121 receives the upward power from the sleeve 70 by the biasing power of the wave washer 60, and the both end portions 52*a* and 52*b* of the lock pin 52 pass through the groove portions 122 and 123, and then the sleeve 70 is separated from the circular cylinder portion 121. Therefore, the antenna mast 100 is detached from the antenna base 20.

In the detachable vehicle antenna 10 as structured above, an electrical conductive path between the socket metal 120 of the antenna mast 100 side and the shaft 51 of the plug metal 50 is secured by two routes, one being led through the socket metal 120, the lock pin 52 and the shaft 51, and the other being led through the socket metal 120, the sleeve 70, the flange portion 53 and the shaft 51, thereby improving the reliability of the electrical connection to the antenna mast 100.

As explained above, according to one embodiment of the detachable vehicle antenna 10 of the present invention, detaching is easy and reliable because the so-called twist lock mechanism is adopted. Under the condition where the antenna mast 100 is attached to the antenna base 20, since the fixed state is maintained by the biasing power of the wave washer 60, the antenna mast 100 would not slacken or fall off by vibration on vehicle driving or leaping over gaps.

Also, since the two electrical conductive paths are secured, the electrical connection with the antenna mast 100 side can be stably conducted.

Further, since the base side connecting mechanism 30 of the antenna base 20 side is formed on the same surface as the upper surface of the base body 21 or is formed to project therefrom, dust is hard to accumulate and waterproof performance is enhanced even under the condition where the antenna mast 100 is detached. Also, since the circular groove 102*a* and the projecting rim portion 43 as well as the concave portions 102*b* and the convex portions 44, which are respectively fitted into each other, are formed on the cover portion 102 and the holder 40 respectively, the effects of preventing the slack and dustproofing and waterproofing of the antenna mast 100 are enhanced.

The same effects can be obtained even when the sleeve 70 per se is formed by using material such as resin having elastic force instead of using the biasing member such as the wave washer 60. Also, though the socket metal 120 directly presses the sleeve 70, it may be structured to press the sleeve 70 through another member.

Furthermore, in FIG. 5, the upper surface of the sleeve 70 is structured to be the same surface as the upper surface of the base body 21, and as shown in FIG. 6, the sleeve 70 is structured to be sunk from the upper surface of the base body 21 along the axial direction of fitting by being pressed with the socket metal 120. However, the present invention is not limited to the above-structure. As long as the sleeve 70 can move along the axis of the plug metal 50 and is placed such that waterproof performance is enhanced and dust is hard to accumulate, the height position of the sleeve is not limited.

Figure 7:
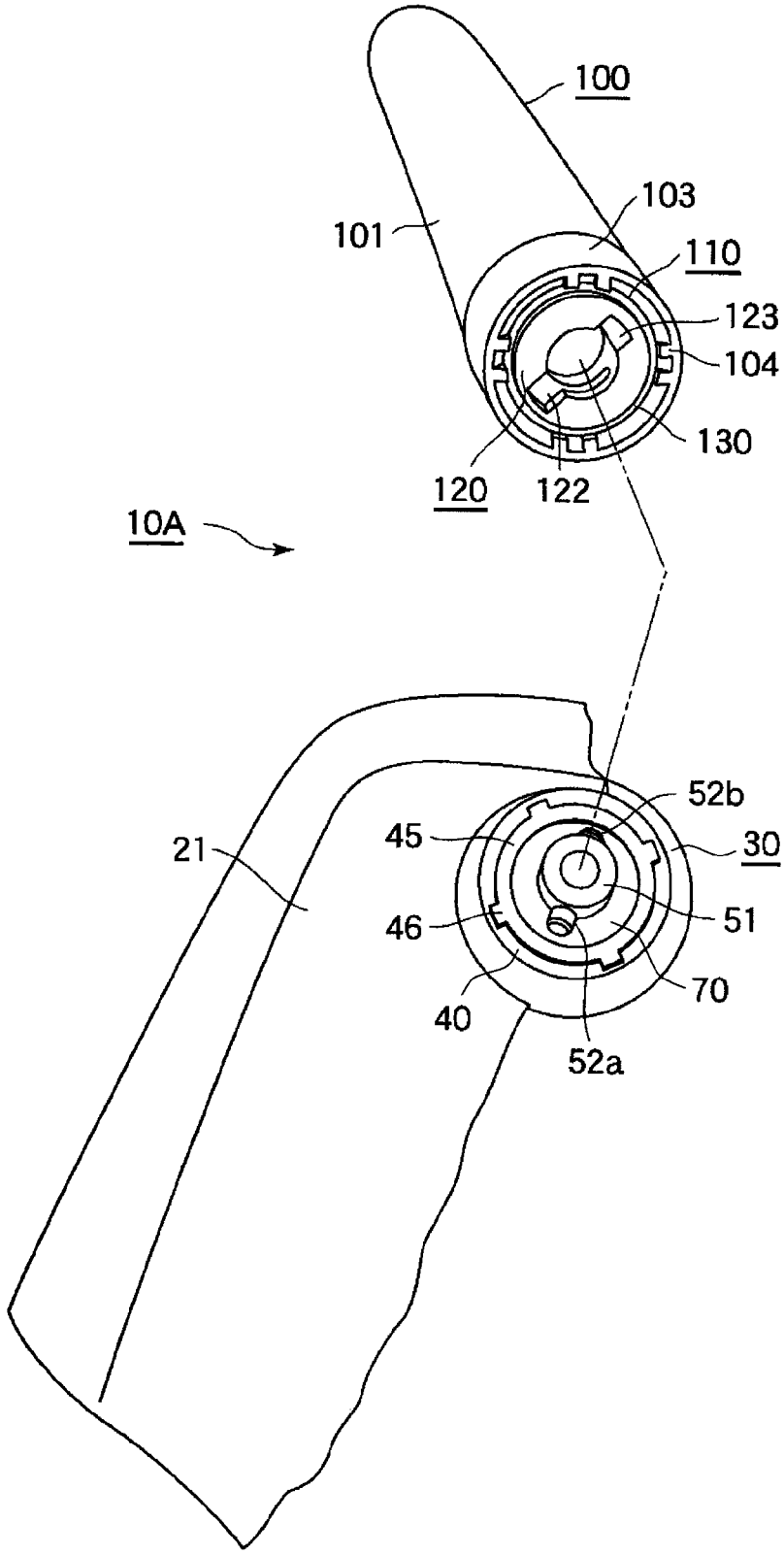
FIG. 7 is a perspective view showing an appearance structure of another embodiment of a detachable vehicle antenna according to the present invention.

FIG. 7 is a perspective view showing an appearance structure of another embodiment of a detachable vehicle antenna 10A according to the present invention. In FIG. 7, the same functional portions as those in FIG. 1 are indicated by the same reference numerals and the detailed description thereof is omitted.

In this modified embodiment, dustproof and waterproof structures formed on an upper surface of the holder 40 and a bottom surface of the antenna mast 100 are different. That is, a projecting rim portion 45 formed circularly, and elongated portions 46 which are formed on every 90 degrees along a circumferential direction of the projecting rim portion 45 and which are elongated to an outward radial direction are formed on the upper surface of the holder 40. The base side connecting mechanism 30 shown in FIG. 7 is illustrated such that the upper surface thereof is formed on a higher portion than the base body 21, but it may be formed on the same surface as the base body 21 like the above explained detachable vehicle antenna 10.

On the other hand, the antenna mast 100 has the mast body 101 of conductive material. A circular cylinder cover 103 is formed on the bottom portion of the mast body 101. Four pairs of engaging projections 104, which are formed toward the center, are provided on an inner peripheral wall of the circular cylinder cover 103. Each of the engaging projections 104 is formed by two board members for supporting the elongated portion 46 of the base side connecting mechanism 30 by sandwiching therebetween. Tip portions of the engaging projections 104 are formed to abut on an outer peripheral surface of the projecting rim portion 45 of the base side connecting mechanism 30.

In the detachable vehicle antenna 10A according to the modified embodiment, detaching is also conducted by the twist lock mechanism just like the above-described detachable vehicle antenna 10. When the antenna mast is attached on the antenna base, the sleeve 70 is pressed by the socket metal 120 and the upper surface of the base side connecting mechanism 30 is covered by the circular cylinder cover 103 of the antenna mast 100. Further, since the tip portions of the engaging projections 104 are formed to abut on the outer peripheral surface of the projecting rim portion 45, waterproof performance and dustproof performance are enhanced. Since the engaging projections 104 support the elongated portions 46 by sandwiching therebetween, rotation of the antenna mast 100 is stopped, so that the antenna mast 100 would not slacken or fall off by vibration on vehicle driving or leaping over gaps.

As described above, in the modified embodiment, the same effect as the above-described detachable vehicle antenna 10 can also be obtained.

As has been described in the forgoing, according to the present invention, even if an antenna has an attachable and detachable antenna mast, dust is hard to accumulate at a connecting portion between the antenna mast and the antenna base, and the antenna has an enough waterproof structure, and further the antenna mast can be reliably attached and detached.

Also, the preferred embodiments described above have been explained in which the antenna is attached on the roof as the detachable vehicle antenna, but the present invention is not limited thereto, and it goes without saying that the invention can easily be adapted to that attached to a trunk lid, a fender, a back door, etc. of a vehicle.

Further, the example in which the plug metal and the sleeve are provided on the antenna base side and the socket metal is provided on the antenna mast side has been explained, but the present invention is not limited thereto, and inversely, the socket metal may be provided on the antenna base side and the plug metal and the sleeve may be provided on the antenna mast side. However, in view of the dustproof performance of the antenna base when the antenna mast is detached, it is preferred that there is no concave portion provided on the antenna base side.

The present invention is also not limited to the above embodiment, and it should be understood that the invention can be implemented by various modifications without departing from the scope of the subject matter. In the above-described embodiments, the sleeve is disposed in a co-axial position around the shaft. However, other position may be adopted as long as the sleeve is structured to be movable along the axial direction. Also, the example in which the sleeve surrounds the periphery of the shaft has been explained, but the present invention is not limited thereto, and the sleeve may be provided on only a part corresponding to a range of a rotational transfer of the socket metal abutted on the sleeve.

Furthermore, the above embodiments may include inventions of various stages, and various inventions may be extracted by combining arbitrarily a plurality of the disclosed components. For example, some components may be deleted from all the components disclosed in the embodiments, and the structure in which some components are deleted may be extracted as an invention as long as at least a problem to be overcome by the present invention can be overcome and at least an effect of the present invention can be obtained.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A detachable vehicle antenna comprising:

an antenna base provided on a vehicle, said antenna base having an antenna base upper surface;

an antenna mast detachably installed to said antenna base such that said antenna mast is movable between an unlocked position and a locked position;

a first connector assembly disposed on said antenna base, said first connector assembly facing in a direction of said antenna mast;

a second connector assembly disposed on said antenna mast, said second connector assembly facing in a direction of said antenna base, said second connector assembly being locked to said first connector assembly when said antenna mast moves from said unlocked position to said locked position; and a lock mechanism connecting mechanically and electrically between said first connector assembly and said second connector assembly, said lock mechanism comprising a movable portion provided on said antenna base, a shaft with a pin connected thereto and a cylinder having pin locking recesses, said movable portion receiving biasing power applied toward said antenna mast, said movable portion having a movable portion upper surface, said pin locking recesses extending in a direction opposite a direction of said applied biasing power, said second connector assembly engaging said first connector assembly such that said movable portion is moved in an axial direction from a first position to a second position when said movable portion is pressed by said cylinder in said axial direction, each pin locking recess receiving one end of said pin such that said pin is locked therein when said antenna mast is in said locked position, said movable portion returning to said first position when said antenna mast is in said unlocked position, said movable portion upper surface being aligned with said antenna base upper surface when said movable portion is in said first position, said movable portion upper surface being located at a position lower than a position of said antenna base upper surface when said movable portion is in said second position.

2. The detachable vehicle antenna according to claim 1, wherein said shaft comprises:

conductive material provided on one of said first connector assembly and said second connector assembly, and protruding toward the other of said first connector assembly and said second connector assembly, said movable portion comprising a seal portion provided on one of said first connector assembly and said second connector assembly, said cylinder being provided on the other of said first connector assembly and said second connector assembly, said cylinder pressing said seal portion during fitting, and said cylinder being connected to said shaft.

3. The detachable vehicle antenna according to claim 2, wherein said seal portion is formed cylindrically to surround a periphery of said shaft, and said cylinder is formed cylindrically in the same axis of said shaft.

4. The detachable vehicle antenna according to claim 3, wherein said seal portion comprises conductive material.

5. The detachable vehicle antenna according to claim 1, wherein said first connector assembly comprises a projecting portion formed about said shaft and on an upper surface facing said second connector assembly, and said second connector assembly comprises a depressed portion formed about said cylinder on an upper surface facing said first connector assembly and fitting into said projecting portion.

6. The detachable vehicle antenna according to claim 2, wherein said pin projects from both sides of said shaft in a radial direction, and projecting amounts of both ends of said pin are different from each other.

7. A detachable vehicle antenna comprising:

an antenna base provided on a vehicle, said antenna base having an upper antenna base surface;

an antenna mast detachably mounted on said antenna base such that said antenna mast is movable between an unlocked position and a locked position;

a first connector assembly disposed on said antenna base, said first connector assembly facing in a direction of said antenna mast;

a second connector assembly disposed on said antenna mast, said second connector assembly facing in a direction of said antenna base; and a lock mechanism, said antenna base being mechanically and electrically connected to said antenna mast via said lock mechanism, said lock mechanism comprising a movable portion provided on said antenna base, a shaft with a pin connected thereto, locking receiving recesses located on a bottom surface of said second connector assembly, lock portions located on said first connector assembly and a cylinder, said movable portion having a movable portion upper surface, said cylinder being arranged in said antenna mast, said cylinder defining a shaft receiving opening, pin receiving grooves and pin locking grooves, said shaft receiving opening receiving said shaft and one pin receiving groove receiving one end of said pin and another pin receiving groove receiving another end of said pin when said antenna mast is in said unlocked position, each of said lock receiving recesses receiving one of said lock portions and one pin locking groove receiving one end of said pin and another pin locking groove receiving another end of said pin when said antenna mast is in said locked position, said second connector assembly engaging said first connector assembly such that said movable portion is moved in an axial direction when said antenna mast moves from said unlocked position to said locked position, said antenna base upper surface being substantially aligned with said movable portion upper surface when said movable portion is in said unlocked position, said movable portion upper surface being located at a spaced location from antenna base upper surface when said movable portion is in said locked position, wherein said movable portion upper surface is located a position below said antenna base upper surface when said movable portion is in said locked position.

8. The detachable vehicle antenna according to claim 7, wherein said shaft comprises conductive material provided on one of said first connector assembly and said second connector assembly, said conductive material extending toward the other of said first connector assembly and said second connector assembly, said movable portion comprising a seal portion provided on one of said first connector assembly and said second connector assembly, said cylinder being provided on the other of said first connector assembly and said second connector assembly, said cylinder pressing said seal portion during fitting, and said cylinder being connected to said shaft.

9. The detachable vehicle antenna according to claim 8, wherein said seal portion is formed cylindrically to surround a periphery of said shaft, and said cylinder is formed cylindrically in the same axis of said shaft.

10. The detachable vehicle antenna according to claim 9, wherein said seal portion comprises conductive material.

11. The detachable vehicle antenna according to claim 8, wherein said pin projects from both sides of said shaft in a radial direction, and projecting amounts of both ends of said pin are different from each other.

* * * * *